United States Patent [19]

Hino et al.

[11] Patent Number: 4,741,010

[45] Date of Patent: Apr. 26, 1988

[54] HIGH VOLTAGE GENERATING APPARATUS FOR X-RAY TUBE

[75] Inventors: Hirofumi Hino, Noda; Masaji Ootakeguchi, Toyonaka, both of Japan

[73] Assignee: Hitachi Medical Corporation, Tokyo, Japan

[21] Appl. No.: 888,980

[22] Filed: Jul. 24, 1986

Related U.S. Application Data

[63] Continuation-in-part of Ser. No. 742,597, Jun. 7, 1985, abandoned.

[30] Foreign Application Priority Data

Jun. 8, 1984 [JP] Japan ..... 59-116411

[51] Int. Cl.[4] ..... H05G 1/20; H05G 1/32

[52] U.S. Cl. ..... 378/105; 378/111; 378/112; 363/17

[58] Field of Search ..... 378/105, 111, 112, 101; 363/17

[56] References Cited

FOREIGN PATENT DOCUMENTS 3520509 12/1985 Fed. Rep. of Germany ..... 378/111

0030102 8/1978 Japan ..... 378/112

*Primary Examiner*—Carolyn E. Fields

*Assistant Examiner*—Joseph A. Hynds

*Attorney, Agent, or Firm*—Antonelli, Terry & Wands

[57] ABSTRACT

A high voltage generating apparatus for an X-ray tube comprises an inverter for converting a DC voltage into an AC voltage, a high voltage transformer for boosting an output voltage of the inverter, a rectifier for converting an output voltage of the transformer into a DC voltage, and a detector for detecting an X-ray tube voltage to produce an output signal corresponding to the X-ray tube voltage. The output signal of the detector is sampled and held by a sample/hold circuit in synchronism with an operating period of the inverter so that the X-ray tube voltage is controlled in accordance with an error between an output signal of the sample/hold circuit and an X-ray tube voltage set level.

15 Claims, 5 Drawing Sheets

HIGH VOLTAGE GENERATING APPARATUS FOR X-RAY TUBE

CROSS-REFERENCE TO RELATED APPLICATION

This is a continuation-in-part of application Ser. No. 742,597, filed on June 7, 1985, now abandoned.

BACKGROUND OF THE INVENTION

The present invention generally relates to a high voltage generating apparatus for an X-ray tube and more particularly to an inverter type high voltage generator for use with an X-ray tube which can provide, with high accuracy, an X-ray tube voltage commensurate with a set voltage.

In the past, an X-ray tube high voltage generator has been used wherein a power supply voltage fed from a commercial power source is applied to a voltage adjustment transformer which adjusts its output voltage or the input voltage of the following transformer by changing the position of its sliding brush connected to the secondary winding thereof or changing output taps connected to the secondary winding, an output voltage of the transformer is transformed to a high voltage by means of a high voltage transformer, and the high voltage is rectified with a rectifier and applied to an X-ray tube.

Recently, a power control technique using power semiconductors has made drastic progress and has been applied to development of an inverter type high voltage generator for an X-ray tube. Thanks to use of semiconductors for power control, the inverter type high voltage generator has a response which is more rapid by far than that of the aforementioned generator using the voltage adjustment transformer. Accordingly, with the inverter type high voltage generator, it is possible to detect an X-ray tube voltage or a value corresponding to the X-ray tube voltage and to enable a feedback control for making an error or difference between a detected voltage and a set level equal to zero, thereby applying a relatively accurate high voltage to an X-ray tube.

FIG. 1 schematically shows a prior art inverter type, X-ray tube high voltage generator adapted for the feedback control. In the figure, there are illustrated a commercial power source 1, a rectifier 2 for converting an AC voltage into a DC voltage, a DC/DC converter 3 receiving the DC voltage outputted from the rectifier 2 and being responsive to a predetermined frequency $f_1$ so as to be repetitiously on-off controlled to control its output DC voltage in accordance with a ratio between an on-time and an off-time (hereinafter referred to as a current conduction ratio), and an inverter 4 comprised of switching elements 4*a* to 4*d*. Simultaneous turn-on of the switching elements 4*a* and 4*d* and simultaneous turn-on of the switching elements 4*b* and 4*c* are effected repetitiously and alternately in response to a predetermined frequency $f_2$ to apply to a primary winding 5*a* of a high voltage transformer 5 an AC voltage at the frequency $f_2$. There are also seen in FIG. 1 a rectifier 6 for converting an AC voltage induced in a secondary winding 5*b* of the transformer 5, a capacitor 7 for smoothing an output DC voltage of the rectifier 6 to provide a smoothed DC voltage, i.e., X-ray tube voltage $v_x$ applied to an X-ray tube 8, an X-ray tube voltage detector 9 for detecting the X-ray tube voltage and producing a detection signal $v_x'$ corresponding to the X-ray tube voltage, an error amplifier 10 for producing a signal a corresponding to an error between the detection signal $v_x'$ and an X-ray tube voltage set level $V_{set}$, and a DC/DC converter controller 11 responsive to the signal a to produce a signal b which controls the current conduction ratio for the DC/DC converter 3.

The error amplifier 10 is typically constructed as shown in FIG. 2, having resistors 21 and 22 of the same resistance $R_1$, an operational amplifier 23, a resistor 24 of a resistance $R_2$, and a capacitor 25 of a capacitance C.

In operation, when starting X-ray radiation, a DC voltage regulated to a predetermined level by the DC/DC converter 3 is converted by the inverter 4 into an AC voltage. This AC voltage is boosted by the high voltage transformer 5, rectified and smoothed by the rectifier 6 and capacitor 7, and applied to the X-ray tube 8. The tube voltage is detected by the X-ray tube voltage applied to the X-ray tube 8 detector 9, and a detection signal $v_x'$ is inputted to the error amplifier 10 to change the level of signal a in accordance with an error from the X-ray tube voltage set level $V_{set}$. In response to a resulting signal a, the DC/DC converter controller 11 produces a signal b which controls the current conduction ratio for the DC/DC converter 3. For example, when the detection signal $v_x'$ is smaller than the X-ray tube voltage set level $V_{set}$, the current conduction ratio for the DC/DC converter 3 is increased to raise the X-ray tube voltage $v_x$. Conversely, when the detection signal $v_x'$ exceeds the X-ray tube voltage set level $V_{set}$, the current conduction ratio for the DC/DC converter 3 is minimized to decrease the X-ray tube voltage $v_x$. In this manner, the X-ray tube voltage $v_x$ is controlled to make the error between the X-ray tube voltage $v_x$ and the X-ray tube voltage set level $V_{set}$ equal to zero.

Incidentally, the X-ray tube voltage $v_x$ takes a waveform which typically is rippled at a frequency of $2f_2$ as shown in FIG. 3. The ripple is caused by the operation of the inverter 4. In the inverter 4, the switching elements 4*a* and 4*d* in one set or the switching elements 4*b* and 4*c* in the other set should be turned on simultaneously and simultaneous turn-on of the switching elements 4*a* and 4*c* or the switching elements 4*b* and 4*d* should be prevented by providing a ceasing period $T_d$ to avoid short-circuiting of the output of the DC/DC converter 3. During the ceasing period $T_d$, no power is transmitted from the DC/DC converter 3 to a succeeding load and consequently, the X-ray tube 8 is powered only by a discharging current from the capacitor 7, resulting in a decrease in the X-ray tube voltage $v_x$. In addition, since a wiring inductance and a leakage inductance and a stray capacitance of the high voltage transformer 5 are coexistent with the inverter 4, high voltage transformer 5 and rectifier 6 and liable to cause load current to oscillate. For these reasons, the pulsation at the frequency $2f_2$ is caused irrespective of the stabilization of the DC voltage in the DC/DC converter 3 and is very difficult to reduce by controlling the DC/DC converter. Therefore, the pulsation at the frequency $2f_2$ must be separated from the feedback control.

In the error amplifier 10 shown in FIG. 2, the input/output relation is given by $$a = \frac{R_2}{R_1(1 + SCR_2)} (V_{set} - v_x')$$

where S is a parameter of Laplace transform. Thus, the output signal a delays by $CR_2$ in responding to the input signal and for $CR_2 > 2f_2/1$, the output signal a will not respond to the $2f_2$ frequency pulsation, thereby making it possible to provide stable control.

In this manner, the error amplifier can be adjusted so as not to respond to the $2f_2$ frequency pulsation by selecting $CR_2$. But, this measure is equivalent to smoothing the $2f_2$ frequency pulsation and hence a smoothed value of the $2f_2$ frequency pulsation is considered to be added to a feedback level. In other words, as shown in FIG. 3, when the X-ray tube voltage has a maximum value $V_p$, a level $V_m$ of the X-ray tube voltage which is averaged in respect of the pulsation is fed back.

The magnitude of the $2f_2$ frequency pulsation depends on the magnitude of the load. For larger X-ray tube currents, the pulsation is aggravated while for smaller X-ray tube currents, the pulsation is suppressed. The maximum value of the X-ray tube voltage $v_x$ is normally defined as an X-ray tube voltage. Accordingly, even when the $2f_2$ frequency pulsation for a small X-ray tube current and that for a large X-ray tube current are averaged to provide the same X-ray tube voltage level $V_m$ as shown in FIG. 4, the X-ray tube voltage is so controlled as to have a level $V_{p1}$ for the small X-ray tube current and a level $V_{p2}$ for the large X-ray tube current.

As described above, since the feedback control is effected through the error amplifier shown in FIG. 2 such that different X-ray tube voltages are to be equal to each other when different magnitudes of different pulsating waves are averaged to the same level, an error is caused between the actual X-ray tube voltage and the X-ray voltage set level.

SUMMARY OF THE INVENTION

An object of the present invention is to provide an inverter type high voltage generating apparatus which can generate an X-ray tube voltage accurately converted to a set level.

The X-ray tube voltage has the waveform accompanied by the $2f_2$ frequency pulsation as shown in FIG. 3 or 4. To prevent an X-ray tube voltage feedback system from responding to the $2f_2$ frequency pulsation, the present invention does away with the integration term of the prior art error amplifier which leads to the unfavorable feedback control referenced to the averaged level of the $2f_2$ frequency pulsation with the result that the X-ray tube voltage peak value, i.e., the working X-ray tube voltage varies with the magnitude of the $2f_2$ frequency pulsation. According to the invention, maximum values of respective pulsating wave components in the $2f_2$ frequency pulsation are sampled and held, and feedback control is effected on the basis of sample and hold values.

DESCRIPTION OF THE PREFERRED EMBODIMENT

Figure 1:
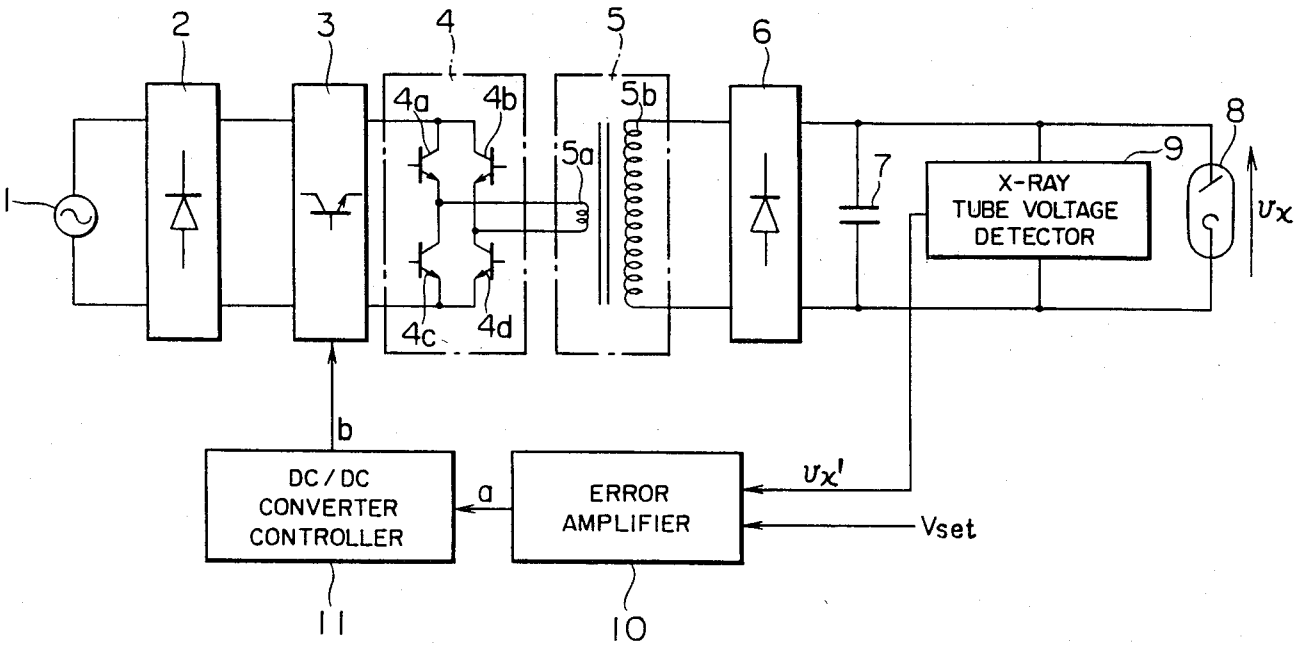
FIG. 1 PRIOR ART
FIG. 1 is a block diagram schematically showing a prior art inverter type, X-ray tube high voltage generator with a feedback arrangement.
Figure 2:
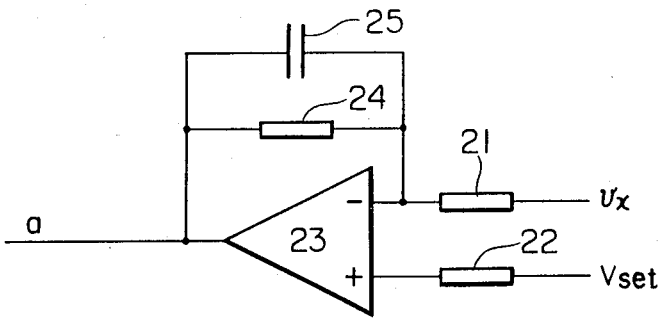
FIG. 2 PRIOR ART
FIG. 2 shows details of an error amplifier.
Figure 3:
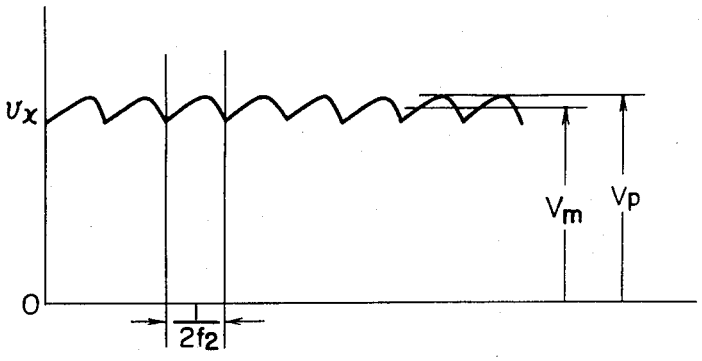
FIG. 3 PRIOR ART
FIG. 3 shows a waveform of an X-ray tube voltage.
Figure 4:
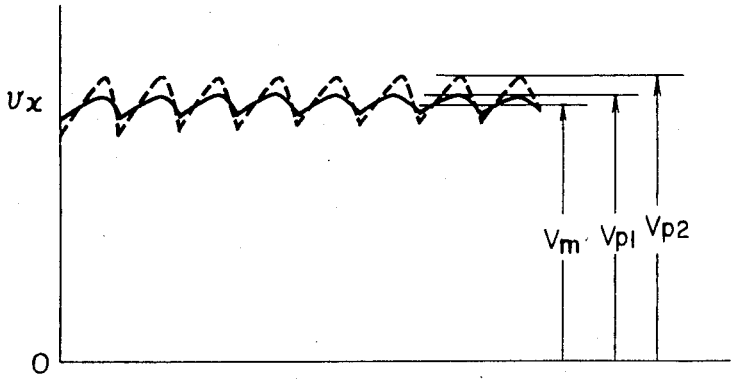
FIG. 4 PRIOR ART
FIG. 4 is a graph for explaining waveform of the X-ray tube voltage obtained with the prior art feedback arrangement.
Figure 5:
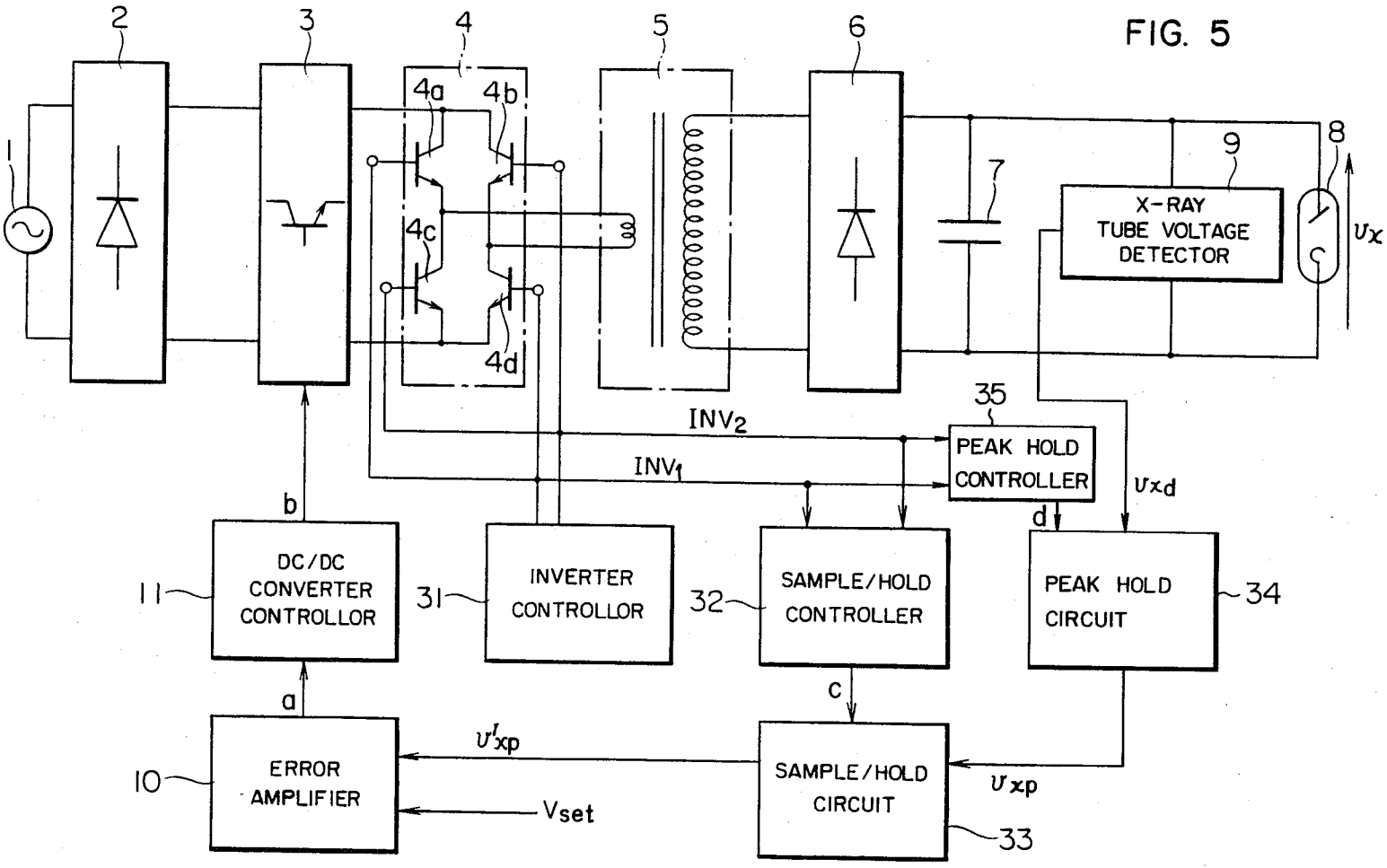
FIG. 5 is a block diagram showing an inverter type, X-ray tube high voltage generator with a feedback arrangement according to an embodiment of the present invention.

The present invention will now be described by way of example with reference to FIGS. 5 to 7. FIG. 5 illustrates, in block form, the construction of an embodiment of the invention. In FIG. 5, components 1 to 11 resemble those of the prior art apparatus shown in block form in FIG. 1 and will not be described herein. Thus, only the additional components will be explained specifically in the following description. This embodiment adds to the FIG. 1 construction an inverter controller 31, a sample/hold controller 32, a sample/hold circuit 33, a peak hold circuit 34, and a peak hold controller 35. These additional components function as will be described below. The inverter controller 31 delivers to the inverter 4 and the sample/hold controller 32 turn-on signals for two switching sections of the inverter 4, that is, a turn-on signal $INV_1$ for the switching elements 4*a* and 4*d* and a turn-on signal $INV_2$ for the switching elements 4*b* and 4*c*. The sample/hold controller 32 delivers out a hold signal c when both the turn-on signals $INV_1$ and $INV_2$ received from the inverter controller 31 are at low level, that is, when the switching operation of the inverter 4 pauses. The peak hold circuit 34 receiving an output signal $v_{xd}$ from the X-ray tube voltage detector 9 detects a peak value of the $v_{xd}$ within a spacing between control signals generated at timings for setting a predetermined period of time and delivers out the peak value as an output signal $v_{xp}$. The sample/hold circuit 33 holds the output signal $v_{xp}$ of the peak hold circuit 34 in timed relationship with the reception of the hold signal c. The peak hold controller 35 produces a signal d for resetting the output signal $v_{xp}$ of the peak hold circuit 34 in accordance with states of the turn-on signals $INV_1$ and $INV_2$ for the inverter 4, more specifically, in timed relationship with maturity of the operation of the sample/hold circuit 33.

With the above construction, the peak value of the tube voltage can be sampled in synchronism with each intermittent switching operation of the inverter 4.

Figure 6:
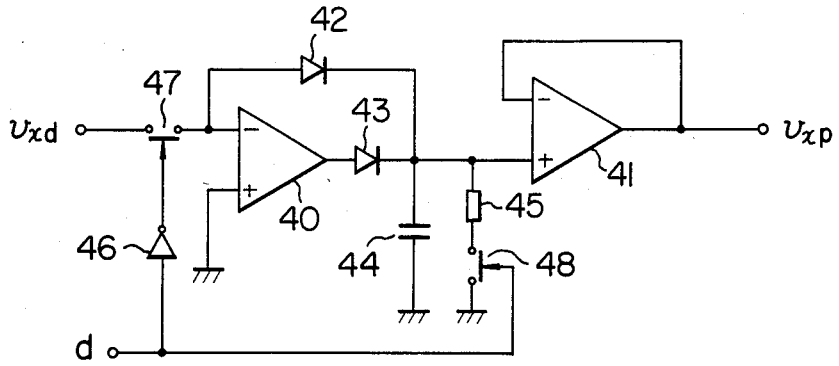
FIG. 6 shows details of a peak hold circuit used in the generator of FIG. 5.

The peak hold circuit 34 is exemplarily configured as shown in FIG. 6. Of operational amplifiers 40 and 41, one operational amplifier 40 cooperates with diodes 42 and 43 to form an ideal diode. A capacitor 44, a discharge resistor 45 for discharging electric charges stored in the capacitor 44, a NOT circuit 46, and switches 47 and 48 are interconnected as illustrated in FIG. 6. The switches 47 and 48 are closed by receiving a signal of "1".

The operation of the peak hold circuit 34 will now be described. When the peak resetting signal d produced from the peak hold controller 35 is "0", the switch 47 is closed by an output signal of "1" from the NOT circuit 46 whereas the switch 48 is operated by the "0" signal d. Then, voltage across the capacitor 44 equals the input voltage, $v_{xd}$, to the peak hold circuit 34 and increases proportionately as the $v_{xd}$ increases. But, after an instant from which the $v_{xd}$ conversely begins to decrease, the voltage across the capacitor 44 can not follow a decreasing $v_{xd}$ on account of the action of the ideal diode composed of the operational amplifier 40 and diodes 42 and 43. In addition, the operational amplifier 41 serves as a voltage follower which exhibits a high input impedance. Consequently, the capacitor 44 can not decrease from a voltage level once charged.

Subsequently, as the peak resetting signal d becomes "1", the output signal from the NOT circuit 46 becomes "0" to open the switch 47 and the other switch 48 is closed. This causes the electric charges stored in the capacitor 44 to discharge through the discharge resistor 45 at a rate of a time constant $\tau$ determined by a capacitance C of the capacitor 44 and a resistance R of the discharge resistor 45. In this manner, the peak hold circuit as exemplified in FIG. 6 can detect and deliver a peak value of the $v_{xd}$ within an interval ranging from the preceding occurrence of "1" of the peak resetting signal d to the immediately succeeding occurrence of "1" of the same.

Figure 7:
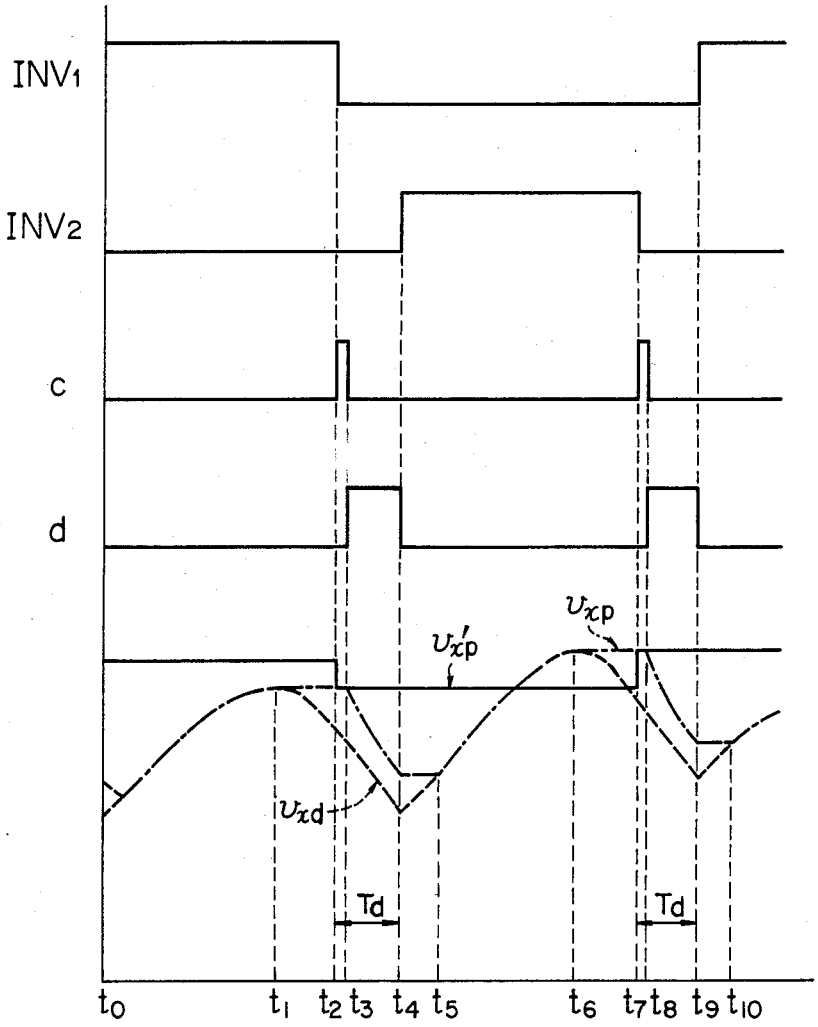
FIGS. 7 and 8 are time charts for explaining the operation of the generator of FIG. 5.

To describe the operation of the FIG. 5 embodiment, reference should particularly be made to FIG. 7. During dosing of X-rays, the inverter controller 31 sends the inverter turn-on signals $INV_1$ and $INV_2$ to the inverter 4, sample/hold controller 32, and peak hold or peak resetting controller 35. The signals $INV_1$ and $INV_2$ are turned on alternately at the frequency $f_2$ with a pause time $T_d$ interposed between on-state of one signal and off-state of the other signal as shown in FIG. 7. The reason why the pause time $T_d$ is provided is that the pause time prevents simultaneous turn-on of the switching elements 4a and 4c or the switching elements 4b and 4d of the inverter 4 and consequent short-circuiting of the output of the DC/DC converter 3.

Considering that the turn-on signal $INV_1$ for the inverter 4 becomes "1" at a given time $t_o$, a load current is passed through the switching elements 4a and 4d to supply power to the load (X-ray tube) so that the tube voltage $v_x$ increases with time, entailing an increase in the output voltage $v_{xd}$ of X-ray tube voltage detector 9 as shown at dotted curve in FIG. 7. Since, at that time, the peak resetting signal d is set to "0", the output voltage $v_{xp}$ of the peak hold circuit 34 is also increased as shown at chained curve in FIG. 7.

As the tube voltage $v_x$ subsequently becomes maximum at time $t_1$ and thereafter decreases, the output voltage $v_{xd}$ of the X-ray tube voltage detector 9 decreases proportionately to the tube voltage $v_x$ but the output voltage $v_{xp}$ of the peak hold circuit 34 is held at a peak level of $v_{xd}$ at the time $t_1$.

With the inverter turn-on signal $INV_1$ changed to "0" at time $t_2$, the sample/hold controller 32 sends to the sample/hold circuit 33 a hold signal c which in turn enables the sample/hold circuit 33 to hold the output $v_{xp}$ from the peak hold circuit 34. In this way, the peak level of the tube voltage $v_x$ can be detected within a half period during which one set of switching elements of the inverter is turned on. The sample/hold circuit 33 then delivers a signal $v'_{xp}$ corresponding to the held $v_{xp}$ to the error amplifier 10.

Subsequently, at time $t_3$ (till then the sample/hold operation has matured), the peak resetting signal d becomes "1" and resets the output voltage of the peak hold circuit 34. This resetting is to make the output voltage $v_{xd}$ of X-ray tube voltage detector 9 inputted to the peak hold circuit 34 correspond to a change in the operation of the inverter within each half period and is especially needed to permit detection even when the $v_{xd}$ is smaller during the second half of the period than during the first half of the period. After the resetting, the output voltage $v_{xp}$ of the peak hold circuit 34 begins to decrease at the time constant $\tau$.

At time $t_4$, the inverter turn-on signal $INV_2$ becomes "1" and power is supplied to the load through the other set of switching elements 4b and 4c. Accordingly, the tube voltage $v_x$ again increases and the output voltage $v_{xd}$ of the X-ray tube voltage detector 9 increases proportionately. The peak resetting signal d again becomes "0" at the time $t_4$, enabling the peak hold circuit 34 to initiate peak level detection. Exemplarily, since in this embodiment, the discharging of the capacitor 44 of peak hold circuit 34 proceeds at a slower rate than the change of the tube voltage $v_x$, the capacitor 44 discharges immaturely and the output voltage $v_{xd}$ of the X-ray tube voltage detector 9 falls below the $v_{xp}$. As a result, the peak hold circuit 34 holds a bottom level at which the discharging is forced to stop. Subsequently, at time $t_5$, the output voltage $v_{xd}$ of the X-ray tube voltage detector 9 exceeds the held bottom level and the output voltage $v_{xp}$ of the peak hold circuit 34 begins to increase proportionately. At time $t_6$, the $v_{xd}$ reaches a peak value, which is sampled and held at time $t_7$.

In the above operation, a value of $v'_{xp}$ corresponding to a peak value of $v_{xd}$ occurring within an interval of time between times $t_o$ and $t_2$ is held and the thus held value is outputted during an interval of time between times $t_2$ and $t_7$; and after the time $t_7$, a value of $v'_{xp}$ corresponding to a peak value of $V_{xd}$ occurring within an interval of time ranging from time $t_4$ to time $t_7$ is held and outputted. Subsequently, this operation is repeated (see FIG. 8).

The output signal $v'_{xp}$ from the sample/hold circuit 33 is supplied to the error amplifier 10 so as to be compared with the tube voltage set level $V_{set}$. If there occurs a difference, a signal a corresponding to the difference is outputted to the DC/DC converter controller 11. In response to the input signal a, the DC/DC converter controller 11 supplies to the DC/DC converter 3 a signal b for controlling the current conduction ratio of the DC/DC converter 3, thereby regulating DC voltage to be supplied to the inverter 4.

Figure 8:
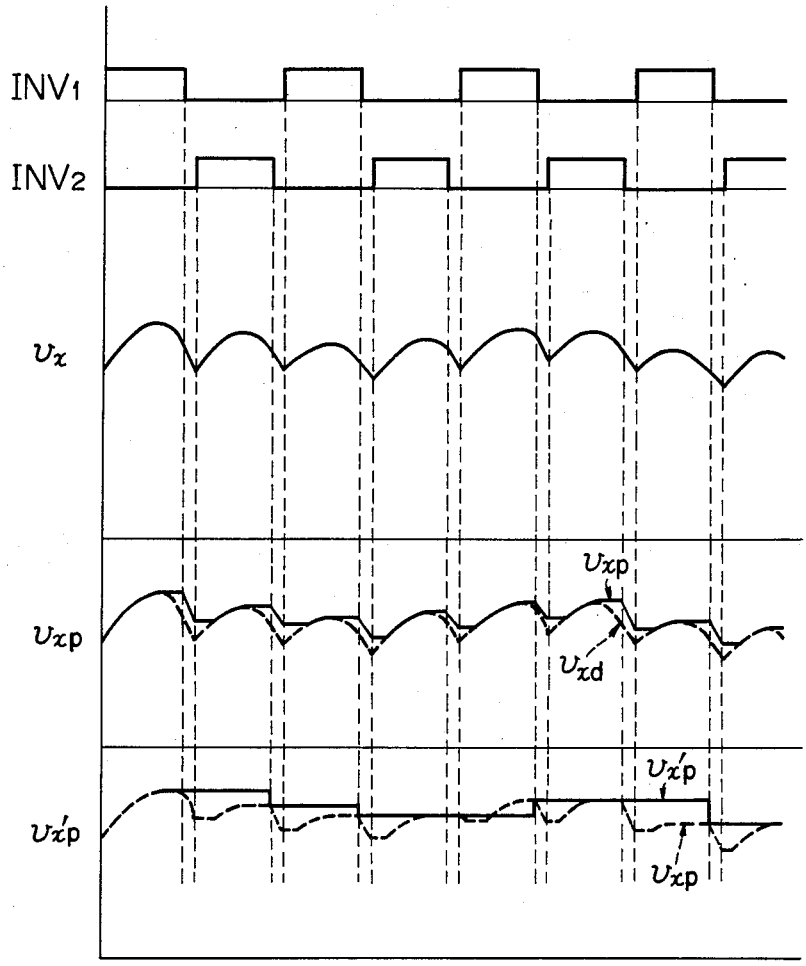

FIG. 8 shows the tube voltage $v_x$ as obtained when the above operation repeats, the relation between the detected X-ray tube voltage value $x_{xd}$ and detected peak value $v_{xp}$, and the relation between the detected peak value $v_{xp}$ and sample/hold value $v'_{xp}$.

As described above, according to the invention, the peak level of the tube voltage is detected during each half period of the inverter and feedback for regulating the tube voltage and hence the preset tube voltage peak level can be regulated accurately without being affected by the $2f_2$ frequency pulsation in the tube voltage.

The error amplifier for X-ray tube voltage control is not limited to an analog operational amplifier but the present invention may be applicable to digital control using a microcomputer. In the digital control, the detection signal is converted into a digital signal by means of an A/D converter, and the digital signal is processed by the microcomputer to determine a current conduction ratio in accordance with an error from the set level. The detection signal must correspond to the X-ray tube voltage peak value. According to teachings of the present invention, the feedback control can be effected by using the X-ray tube voltage peak value, and the X-ray tube voltage peak value can be accurately converted to the set level.

In case where the conversion rate of the A/D converter is slower as compared to the operation period of the inverter, it is advantageous to sample the detection signal in synchronism with the operation of the inverter by reducing the sampling frequency to a fraction of an integer, for example, ½ of the inverter operating frequency.

When the present invention was applied to an inverter type, X-ray tube high voltage generator of 2kW output power and 200 Hz operating frequency the advantageous effect was proven as below. During X-ray radiation, the generator was operated to supply power to the load with about 10% current conduction ratio of the inverter and remaining 90% discharge from the high voltage capacitor. When this generator was combined with a conventional feedback system having an X-ray tube voltage set level of 40 KV, the X-ray tube voltage peak value was 40 KV for an X-ray tube current of 0.5 mA but was 47 kV for an X-ray tube current of 3 mA. Then, the generator was combined with the feedback system according to the invention to obtain an X-ray tube voltage peak value of 40 KV which accurately converger to the X-ray tube voltage set level irrespective of different values of the X-ray tube current.

As has been described, the present invention permits the feedback control referenced to the X-ray tube voltage peak value and consequently the X-ray tube voltage can be obtained which is accurately commensurate with the set level.

We claim:

1. A high voltage apparatus for generation of X-rays comprising:

a DC/DC converter means for converting a DC voltage into a suitable DC voltage, said DC/DC converter means being controllable by changing its on-off time ratio to produce a variable output voltage;

an inverter means for converting the output voltage of said DC/DC converter means into an AC voltage, said inverter means having first and second switching means which are alternately and periodically turned on;

a high voltage transformer having primary and secondary windings, for boosting the output voltage of said inverter;

a rectifier means for converting an output voltage of said high voltage transformer into a DC voltage;

an X-ray tube supplied with an output voltage of said rectifier means through a high voltage cable;

an X-ray tube voltage detector means for detecting a tube voltage applied to said X-ray tube to produce a signal corresponding to a detected value;

a first detector means for detecting a peak value of the output signal of said X-ray tube voltage detector means;

a sample/hold circuit means for sample/holding an output signal of said first detector means;

a first controller means for controlling the operation of said sample/hold circuit means in synchronism with a frequency of said inverter means;

a second controller means for resetting an output signal of said first detector means in accordance with a predetermined sample/hold operation of said sample/hold circuit means; and a third controller means responsive to a difference between an output signal of said sample/hold circuit means and a tube voltage set signal to regulate the output voltage of said DC/DC converter means.

2. A high voltage apparatus according to claim 1, wherein said inverter means operates at a period containing a predetermined pause interval ranging from turn-off of one of said first and second alternate turn-on switching means to turn-on of the other of said first and second alternate turn on switching means.

3. A high voltage apparatus according to claim 1, wherein said inverter means comprises a series connection circuit of first and second switching elements, and another series connection circuit of third and fourth switching elements, the two series connection circuits being connected in parallel with each other across output terminals of said DC/DC converter means, a junction between said first and second switching elements and a junction between said third and fourth switching elements being separately connected to the primary winding of said high voltage transformer.

4. A high voltage apparatus according to claim 3, wherein said inverter means has a set of the first and fourth switching elements and another set of the second and third switching elements, the sets being on-off operated alternately.

5. A high voltage apparatus according to claim 1, wherein a high voltage rectified by said rectifier means is smoothed by a smoothing capacitor and then supplied to said X-ray tube.

6. A high voltage apparatus according to claim 2, wherein said first controller means delivers to said sample/hold circuit means a pulse-like signal in synchronism with off-states of said first and second switching means of said inverter means, and said second controller means delivers to said first detector means a reset signal during an interval of time ranging from turn-off of said pulse-like signal to turn-on of either one of said first and second switching means.

7. A high voltage apparatus according to claim 1, wherein said first detector means has a first switch through which the detected tube voltage value is held as electric charges in a capacitor, and a second switch through which the electric charges stored in said capacitor are discharged, said first and second switches being operated complementarily to each other by a reset signal from said second controller means.

8. A high voltage apparatus according to claim 6, wherein means are provided for selecting an on-interval of time of the pulse-like signal and an on-interval of time of the reset signal summed to be equal to the pause interval of said inverter means.

9. An high voltage apparatus according to claim 7, wherein said first detector means includes means for turning off first switch when said reset signal is on and for turning on said first switch when said reset signal is off, said second switch being operated complementarily to said first switch.

10. A high voltage apparatus for generation of X-rays comprising:

DC/DC converting means for converting a DC input signal into a suitable DC output voltage;

an inverter means for converting the output voltage of said DC/DC converting means into an AC voltage, said inverter means including first and second switching means;

inverter control means for driving said first and second switching means of said inverter means alternately and periodically with a predetermined pause interval of time;

a high voltage transformer for boosting an output voltage of said inverter means, said high voltage transformer having primary and secondary windings;

rectifying means for converting an output voltage of said high voltage transformer into a DC output voltage;

an X-ray tube applied with the output voltage of said rectifying means as a tube voltage through a high voltage cable;

tube voltage detecting means for detecting the tube voltage applied to said X-ray tube to deliver an output signal corresponding to a detected value;

peak value detecting means for detecting and holding a peak value of the output signal of said tube voltage detecting means and for delivering an output signal corresponding to the peak value;

sample/hold means for sampling/holding the output signal of said peak value detecting means in synchronism with the timing of turn-off of each of said first and second switching means and for delivering an output signal corresponding to a sampled/held value;

means for outputting a reset signal to said peak value detecting means each time a sample/hold operation of said sample/hold means is completed, said reset signal resetting the peak value which has been detected and held by said peak value detecting means; and control means for regulating the output voltage of said DC/DC converting means so as to make a difference between the output signal of said sample/hold means and a tube voltage set value signal equal to zero.

11. A high voltage apparatus according to claim 10, wherein said sample/hold means includes a sample/-hold circuit and a sample/hold controller for supplying a pulse-like sample/hold command signal in synchronism with the outputting of a signal for turn-off of each of said first and second switching means from said inverter control means.

12. A high voltage apparatus according to claim 11, wherein means are provided for selecting a sum of an on-interval of time of said reset signal and an on-interval of time of said pulse-like sample/hold command signal equal to a predetermined pause interval of time of said inverter means.

13. A high voltage apparatus according to claim 10, wherein said peak value detecting means includes a capacitor in which the detected peak value is held as electric charges through a first switch and a resistor to which the held value as the electric charges are discharged through a second switch, said first switch being turned on when said reset signal is at a low level and turned off when said reset signal is at a high level, said second swtich being turned on when said reset signal is at the high level and turned off when said reset signal is at the low level.

14. A high voltage apparatus according to claim 10, wherein said inverter means includes a first series connection circuit of first and second switching elements and a second series connection circuit of third and fourth switching elements, said first and second series connection circuits being connected in parallel with each other across output terminals of said DC/DC converting means, a junction between said first and second switching elements and a junction between said third and fourth switching elements being respectively connected to opposite ends of the primary winding of said high voltage transformer, one of said first and second switching elements and one of said third and fourth switching elements forming said first switching means, the other of said first and second switching elements and the other of said third and fourth switching elements forming said second switching means.

15. A high voltage apparatus according to claim 10, wherein the output voltage of said rectifying means is smoothed by a smoothing capacitor and then applied to said X-ray tube.

* * * * *